United States Patent [19]

McPherson

[11] Patent Number: 4,919,302

[45] Date of Patent: Apr. 24, 1990

[54] TISSUE BOX WITH DISPOSAL COMPARTMENT

[76] Inventor: Donald S. McPherson, P.O. Box 156, Murphy, Oreg. 97533

[21] Appl. No.: 299,348

[22] Filed: Jan. 23, 1989

[51] Int. Cl.[5] ..... B65H 1/04

[52] U.S. Cl. ..... 221/34; 221/102; 221/305; 229/120.08

[58] Field of Search ..... 221/34, 102, 305; 229/120.1, 120.08, 120.09

[56] References Cited

U.S. PATENT DOCUMENTS 2,345,309 3/1944 Wensel ..... 221/34

2,841,276 7/1958 Schwimmer et al. ..... 221/34 X

*Primary Examiner*—F. J. Bartuska

*Attorney, Agent, or Firm*—John F. Ingman

[57] ABSTRACT

A tissue box with disposal compartment includes a conventional compartment for the holding and dispensing of new tissues, and a second compartment for the disposal of used tissue which folds out from a side of the new tissue compartment. The used tissue disposal compartment is integrally attached to the new tissue dispensing compartment, having a common side wall therewith, and may be arranged in a folded position against the common side wall when not in use, or in an extended position for receiving used tissue. Two foldable side walls unfold into the extended position, with the fourth side wall being attached to the outer edge of the two folding side walls. A bottom wall is foldingly attached at the lower end of the common side wall so that when bent up, into the folded position, it lies against the common side wall, while in the extended position it rotates down to form the bottom of the used tissue compartment. The bottom wall may be attached to the lower end of the fourth side wall by a tab extending from the bottom wall and a tab opening in the lower portion of that lower side wall. Attachment of one or more narrow strips of flexible material between the two foldable side walls at their lower edges provides support for the bottom wall and also holds the foldable walls from bowing outwards. The tissue box with disposal compartment may be formed from a single paperboard blank.

5 Claims, 3 Drawing Sheets

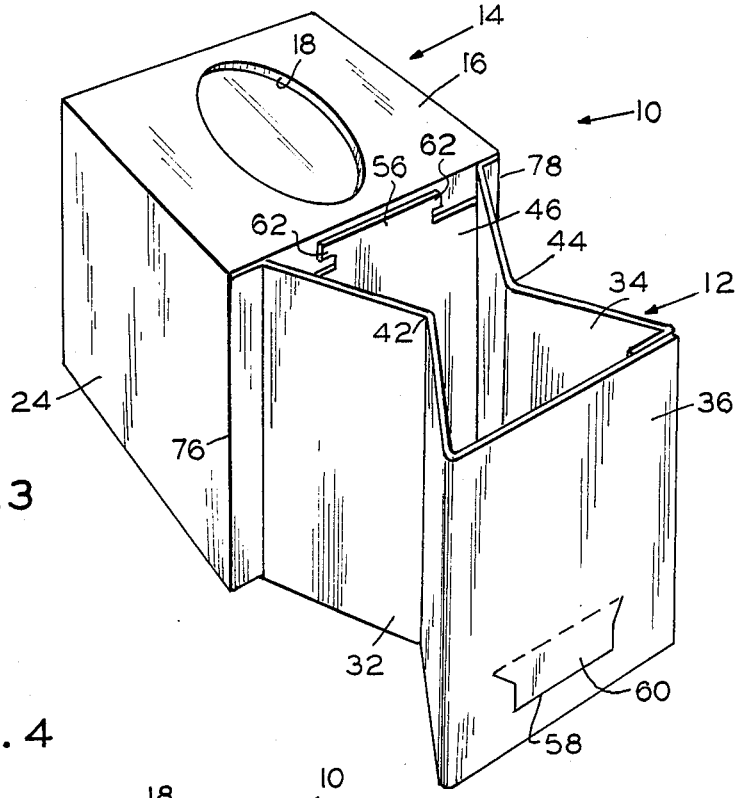
FIG. 3
FIG. 4
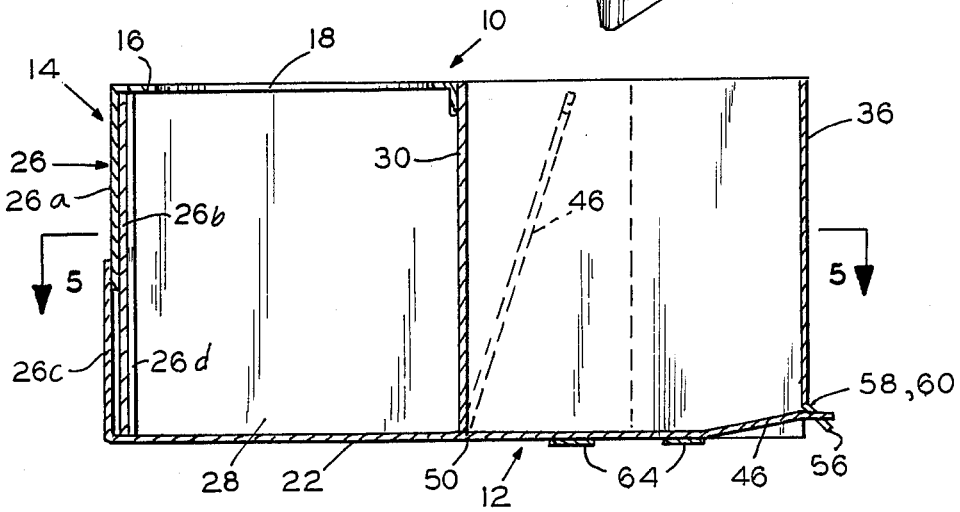
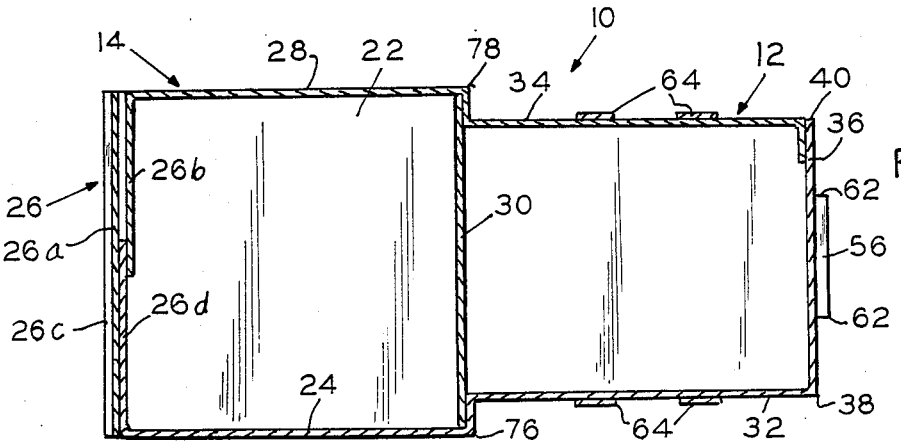
FIG. 5

TISSUE BOX WITH DISPOSAL COMPARTMENT

BACKGROUND OF THE INVENTION

1. Field of the Invention

This invention involves tissue containers, and, more particularly, tissue boxes having a used tissue disposal compartment.

2. Description of the Prior Art

Tissues are conventionally packaged in convenient containers which dispense the tissues one at a time through an opening. Many current boxes of tissue are decorated so as to provide an attractive appearance, and are suitable for location in many places. Most absorbent tissues are utilized on a single-use basis, and the manner of such use and the form after use make it highly desirable to immediately dispose of the tissue in a sanitary manner. However, the locations for boxes containing new tissue do not necessarily correspond with means to dispose of used tissue, therefore requiring the user to search for a suitable disposal site, or even temporarily store the used tissue in a pocket, waist-band or purse, until proper disposal can be attained. Alternatively, the offending tissue may be simply placed loosely next to the box of new tissue for someone else to dispose of. Since used tissue is normally offensive and unsanitary, the most suitable location for the immediate disposal of such tissue is in an easily emptied container proximate to the source of tissue.

What is needed is a tissue box which has, in addition to a compartment for dispensing new tissue, a second compartment which is available, if desired, for the disposal of used tissue. The new tissue compartment and the used tissue compartment should be hygienically separated from each other, yet be part of a common structure. To gain acceptance from manufacturers, this dual compartment structure should be as compact as possible for marketing, and be simple and economical to manufacture, preferably cut from stock material as a single blank.

SUMMARY OF THE INVENTION

The present invention provides a tissue box with disposal compartment which is designed to satisfy the aforementioned needs. The invention involves a compartment for the holding and dispensing of new tissues, and a second compartment, for use in the disposal of used tissue, which conveniently folds out from a side of the new tissue compartment.

Accordingly, the tissue box with disposal compartment, in its preferred embodiment, includes a new tissue dispensing compartment having a top wall with an opening formed for the dispensing of tissues, a bottom wall, and four side walls, with each side wall joined at right angles to the top and bottom walls and adjacent side walls to form a conventional appearing tissue box. A second compartment, which may be used for the disposal of used tissue, is integrally attached to the new tissue dispensing compartment, having a common wall therewith. The second compartment may be arranged in a folded position against the common wall when not in use, or in an extended position for receiving used tissue. The used tissue disposal compartment thus also includes four side walls, with one side wall being common to a substantial portion of one of the side walls of the new tissue dispensing compartment, two side walls which are foldable between the folded position and the extended position, and a fourth side wall which is attached to the outer edge of the two folding side walls. A bottom wall is foldingly attached at the lower end of the common side wall so that when bent up, into the folded position, it lies against the common side wall, while in the extended position it rotates down to form the bottom of the used tissue compartment. The bottom wall may be attached to the lower end of the fourth side wall by means of a locking tab extending from the bottom wall engaging into a locking tab opening in the fourth side wall.

Additional support at the bottom of the used tissue disposal compartment may be added by attaching one or more narrow strips of flexible material between the two foldable side walls at their lower edges so that such strip(s) will support the bottom wall and also hold the foldable walls from bowing outwards.

To maintain a sterile environment for the tissue in the new tissue dispensing compartment, where the folding side walls intersect with the common side wall, the folding side walls may be folded inwards and sealingly joined along the common side wall, thereby hygienically separating the two compartments.

The preferred tissue box with disposal compartment may be formed from a single paperboard blank.

BRIEF DESCRIPTION OF THE DRAWINGS

FIG. 3 illustrates the tissue box with disposal compartment in an interim position as it is being unfolded to the extended position.

FIG. 4 illustrates a side sectional view of the tissue box with disposal compartment, with the disposal compartment in extended position, and also showing, in dashed lines, an interim position of the bottom wall in the unfolding process.

FIG. 5 illustrates a top sectional view of the tissue box with disposal compartment extended, as seen at line 5—5 of FIG. 4.

DESCRIPTION OF THE PREFERRED EMBODIMENT

Figure 1:
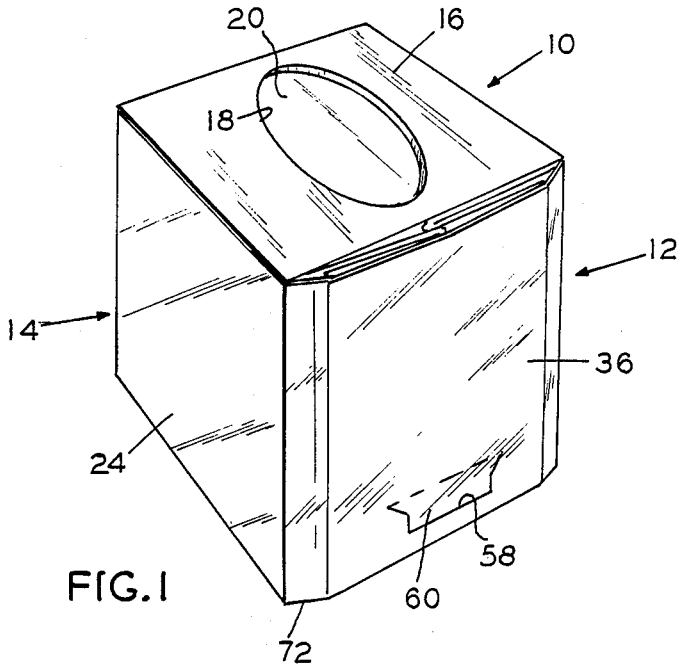
FIG. 1 illustrates the preferred embodiment of the tissue box with disposal compartment, with the used tissue disposal compartment in folded position.
Figure 2:
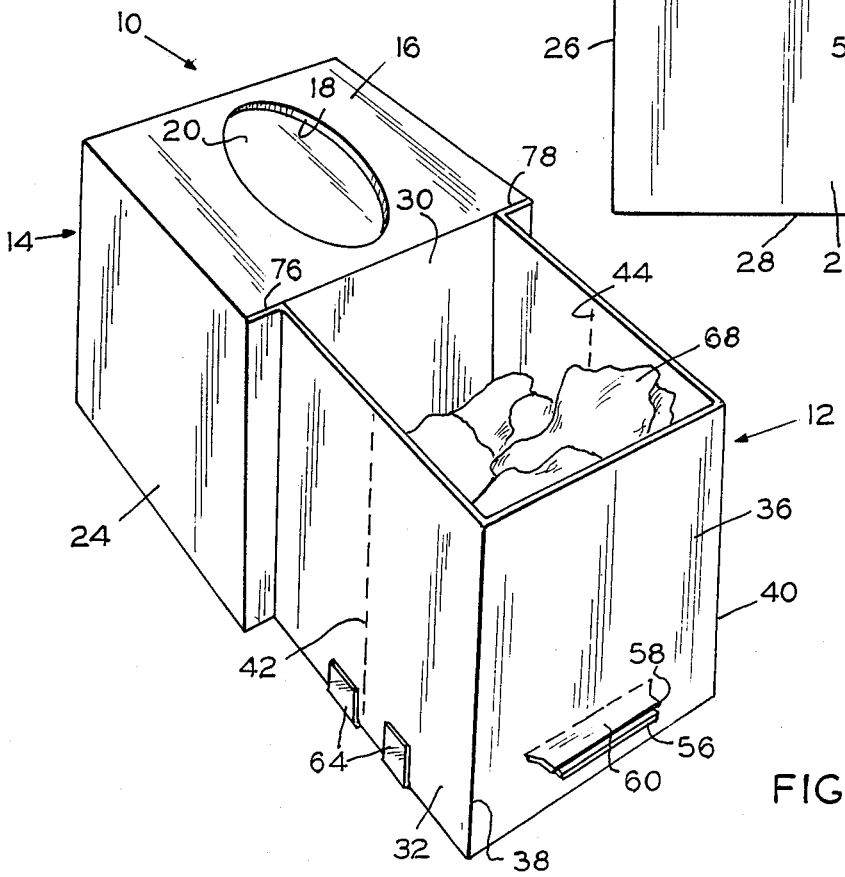
FIG. 2 illustrates the tissue box with disposal compartment with the used tissue disposal compartment in extended position.

Referring now to the drawings, there is shown in FIG. 1 the preferred embodiment of the tissue box with disposal compartment 10 with the used tissue disposal compartment 12 in folded position, while FIG. 2 illustrates the box 10 with the used tissue disposal compartment 12 in extended position, ready for use.

The tissue box 10 thus includes two separate compartments, a new tissue dispensing compartment 14 and a used tissue disposal compartment 12 which are integrally attached to each other The new tissue dispensing compartment 14 is rectangularly shaped and includes a top wall 16 having an opening 18 formed for the dispensing of the included, conventionally-packaged, new tissues 20; a bottom wall 22 forming the base of the compartment 14; and four side walls 24, 26, 28, and 30, which when assembled form a hollow tissue-holding compartment 14 from which contained tissue 20 is dispensed.

The used tissue disposal compartment 14, which is formed integrally with the new tissue dispensing compartment 16, has two positions, as indicated above, a folded position as seen in FIG. 1 and an extended position, as seen in FIG. 2. The used tissue disposal compartment 12 also has four side walls 30, 32, 34, 36 where side wall 30 is common to both the new tissue dispensing compartment 14 and the used tissue disposal compartment 12. In the extended position, side walls 32 and 34 extend at right angles to side wall 30, and side wall 36 is joined to the outer edges 38 and 40 respectively of side walls 32 and 34, so that when in extended position each of the side walls 30, 32, 34, and 36 are oriented at right angles to their adjacent side walls, as illustrated. Side walls 32 and 34 are foldable along folds 42 and 44, so that when the used tissue disposal compartment 12 is folded inward toward side wall 30, the folded side walls 32 and 34, with attached side wall 36 lay in close proximity to side wall 30. The bottom wall 46 is foldingly joined at 50 the lower end of side wall 30, so that in the folded position the bottom wall 46 is rotated upwardly along the fold 50 against side wall 30, and in the extended position it is rotated downwards to form the bottom of the used tissue disposal compartment 12.

Means are provided to attach the bottom wall 46 to the side wall 36. At the outer end 54 of the bottom wall 46, a locking tab 56 projects, which in the extended position, will engage with a locking tab opening 58 which is formed in the lower portion 68 of side wall 36. The locking tab opening 58 preferably is constructed with a flap 60 which, upon entrance of the tab 56 into the opening 58, may be pushed down to hold the ears 62 of tab 56 within the reduced dimension of the lower portion of the locking tab opening 58.

Figure 6:
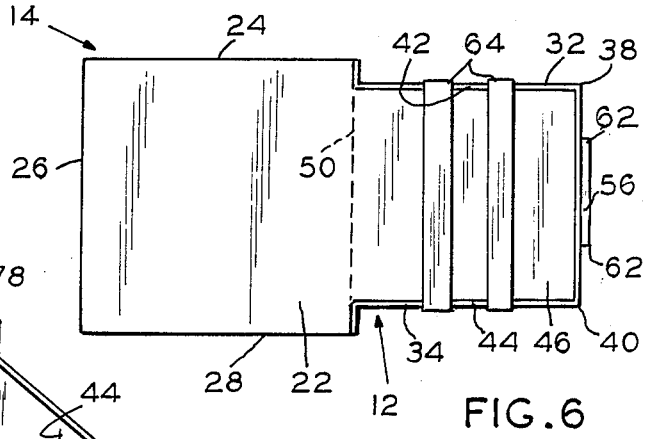
FIG. 6 illustrates a bottom view of the tissue box with disposal compartment with the disposal compartment extended and supplemental support bands utilized.

Supplemental support bands 64, as illustrated in FIG. 6 may be added, spanning the bottom wall 46 of the used tissue disposal compartment 12. One or more (two as illustrated) narrow bands 64 of a thin flexible material such as cellophane, may be attached, as with adhesive, between side wall 32 and side wall 34 so as to provide additional support for the bottom wall 46 and to prevent walls 32 and 34 from bowing out from the pressure of the used tissue 68. The use of such support bands 64 may be desirable, especially when the paperboard utilized in the tissue box 10 construction is thin and flexible.

Figure 7:
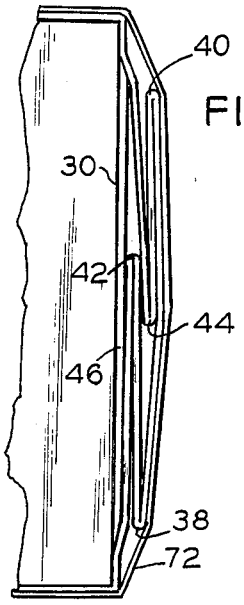
FIG. 7 illustrates the bottom and sides of the disposal compartment folded against the new tissue dispensing compartment in folded position, and held there by a wrap encircling the tissue box.

When in the folded position, as illustrated in FIG. 1 and with the folds enlarged in FIG. 7, it may be desirable to provide a means to restrain the used tissue compartment 12 from partially unfolding. This may be accomplished in several ways, the preferred manner being a thin transparent wrap 72 about the tissue box 10 which holds the used tissue disposal compartment 12 in folded configuration. Such wrap 72 may be horizontal, as illustrated, or may be vertically oriented about the box (not shown) where it also may perform the function of sealing the opening 18 prior to use.

Figure 8:
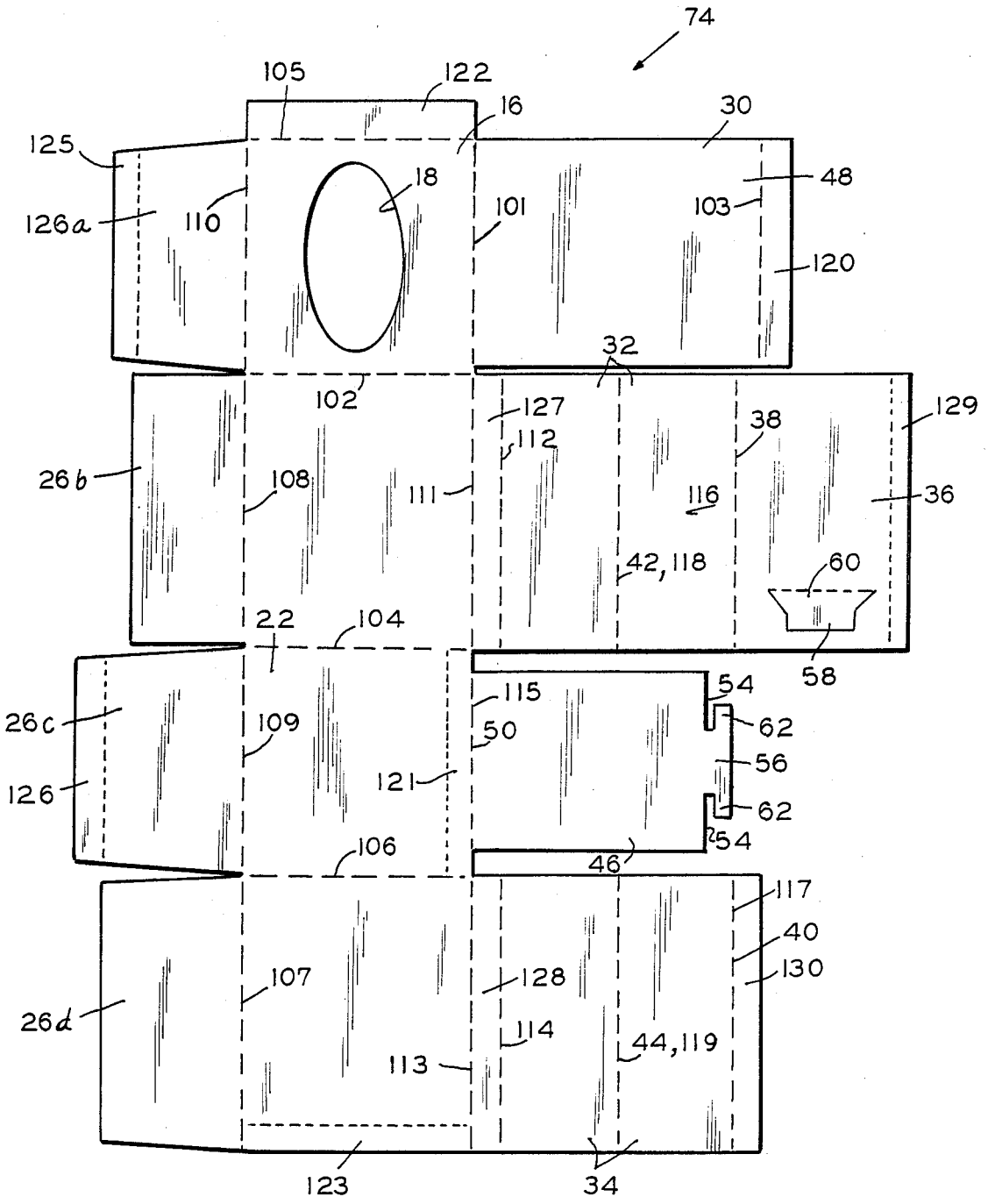
FIG. 8 illustrates the tissue box with disposal compartment in a preassembly plan view of the single paperboard blank.

Turning now to FIG. 8, there is seen a single blank 74, preferably of paperboard as tissue boxes are conventionally constructed, from which the above described tissue box with disposal compartment 10 may be formed. In FIG. 8, flaps 26*a*, 26*b*, 26*c*, and 26*d* are conventional components of side wall 26. A manner of construction of the tissue box with disposal compartment 10, utilizing blank 74, is described below, although other sequences of folding and glueing the tissue box with disposal compartment 10 may be equally satisfactory.

Folds 101, 102, 103, and 104 are bent at right angles so that face 120 abuts face 121, and face 120 is adhesively attached to face 121. Folds 105 and 106 are bent at right angles so that face 122 abuts face 123, and the face 122 is adhesively attached to face 123, preferably with face 122 on the inside of face 123. The ne tissues 20 may be inserted into the partially formed new tissue dispensing compartment at this time. Folds 107, 108, 109 and 110 are now bent at right angles, so that face 125 abuts face 126 on the outside of the new tissue compartment 14, where the faces 125 and 126 are adhesively joined, completing side wall 26.

As noted above, although more complex, it is preferable to seal the intersections 76 and 78, as best seen in FIG. 5, between the side wall 30 and side walls 24 and 28 respectively. This is accomplished, using the form of blank 74, by bending folds 111 and 112 adjacent to side wall 32, and folds 113 and 114 adjacent to sidewall 34, so that face 127 and face 128 lie across the intersections 76 and 78, where face 127 and 128 are adhesively attached to wall 30. Side walls 32 and 34 extend outwardly at folds 112 and 114, respectively. Fold 115 is bent at a right angle so as to lay the bottom wall 46 adjacent to side wall 30. Fold 116 is bent to form side wall 36 and fold 117 is bent to form face 130 which is adhesively attached to face 129 on sidewall 36. Finally, folds 118 and 119, corresponding to folds 42 and 44, respectively, are folded, and the sidewalls 32 and 34 of the used tissue disposal compartment 12 are bent, in accordian fashion, to a position adjacent to bottom wall 30, as seen in FIG. 1. A clear wrap 72, as desired, is fashioned about the tissue box with disposal compartment 10 to hold the used tissue disposal compartment 12 in the folded position for marketing.

It is thought that the tissue box with disposal compartment of the present invention and its many attendant advantages will be understood from the foregoing description and that it will be apparent that various changes may be made in form, construction and arrangement of the parts thereof without departing from the spirit and scope of the invention or sacrificing all of its material advantages, the forms hereinbefore stated being merely exemplary embodiments thereof.

I claim:

1. A tissue box with disposal compartment, having a new tissue dispensing compartment and a used tissue disposal compartment which is integrally attached to said new tissue dispensing compartment, which is formed from a single material blank and which comprises:

a rectangular area having four successive sections, of which, when folded, a first section forms a top wall, a second section forms a first side wall, a third section forms a bottom wall and the fourth section forms a second and opposing side wall to the first side wall of the second section, all said walls being of said new tissue dispensing compartment, the effective width of the four sections being equal and the effective length of the first and third sections and of the second and fourth sections being equal;

said rectangular area having along a common side a transverse extension from each of the four sections so that a third side wall of the new tissue dispensing compartment is formed therefrom when folded;

said rectangular area having a fifth transverse extension, from said first section, of a width equal to the length of the first section and an effective transverse length equal to the length of said second and fourth sections; said fifth transverse extension forming, when folded, both a fourth side wall of said new tissue dispensing compartment, opposing said third side wall of that compartment, and also a first side wall of said used tissue disposal compartment.

said rectangular area having a sixth transverse extension from said third section, said sixth transverse extension forming, when unfolded, a bottom wall of said used tissue disposal compartment;

said sixth transverse extension having at its outer end a projecting tab;

said rectangular area having a seventh transverse extension, from said fourth section, having a width equal to the length of the first section and an effective transverse length equal to the length of the used tissue disposal compartment, thereby forming a second side wall of said used tissue disposal compartment;

said rectangular area having an eighth transverse extension, from said second section, having a width equal to the length of the second section and the width of the seventh transverse extension, and an effective transverse length equal to the effective transverse length of the seventh transverse extension, plus the effective width of the sixth transverse extension, so as to form, when folded, both a third side wall and a fourth side wall, the latter opposing the first side wall of the used tissue disposal compartment as provided by the fifth transverse extension;

said eighth transverse extension having at its outer portion, corresponding to the fourth side wall, a tab opening for reception of the tab of the sixth transverse extension.

2. A tissue box with disposal compartment, which comprises:

a. a new tissue dispensing compartment, which includes:

(1) a top wall, having a opening formed for the dispensing of tissues;

(2) a bottom wall;

(3) four side walls oriented at right angles to said top and bottom walls; and b. a used tissue disposal compartment, integrally attached to said new tissue dispensing compartment and having, relative to said new tissue dispensing compartment, a folded position for transport and storage and an extended position for use, said used tissue disposal compartment comprising:

(1) four side walls, where:

(a) a first side wall is common to a substantial portion of one of the four side walls of said new tissue dispensing compartment;

(b) a second side wall and a third side wall which extend at right angles to the first side wall and are spaced to form opposing side walls in said extended position;

(c) said second and third side walls being foldable so as to lie in proximity to said first side wall while in the folded position;

(d) a fourth side wall connected to said second and third side walls so that, with the second and third side walls in the extended position, the fourth side wall forms a spaced and opposing side wall to said first side wall; and when the second and third side walls are in the folded position, the fourth side wall is substantially parallel to and in the proximity to the first side wall;

(2) a bottom wall which is foldingly attached to the first side wall lower end so that when in the folded position it lies substantially parallel to and in proximity to the first side wall, and in the extended position, unfolds to form the bottom of the used tissue disposal compartment; and (3) means for attaching said bottom wall to said fourth wall in the extended position, which includes:

(a) a tab extending from the bottom wall;

(b) a tab opening in the lower portion of said fourth side wall, formed so that when the side walls are in extended position, and the bottom wall is unfolded to form the bottom of the compartment, the tab will engage in said tab opening.

3. The tissue box with disposal compartment, as recited in claim 2, wherein the used tissue disposal compartment is retained in the folded position in proximity to the common side wall of the new tissue dispensing compartment by a flexible wrap encircling the new tissue dispensing compartment.

4. A tissue box with disposal compartment, as recited in claim 2, wherein, additionally, at least one flexible supporting band extends between said second and third side walls and beneath the bottom wall of said used tissue disposal compartment.

5. A tissue box with disposal compartment, as recited in claim 2, wherein the tissue box is formed from a single blank of material.

* * * * *